US009165565B2

(12) United States Patent
Mysore et al.

(10) Patent No.: US 9,165,565 B2
(45) Date of Patent: Oct. 20, 2015

(54) SOUND MIXTURE RECOGNITION

(75) Inventors: Gautham J. Mysore, San Francisco, CA (US); Paris Smaragdis, Urbana, IL (US); Juhan Nam, Stanford, CA (US)

(73) Assignee: Adobe Systems Incorporated, San Jose, CA (US)

( * ) Notice: Subject to any disclaimer, the term of this patent is extended or adjusted under 35 U.S.C. 154(b) by 661 days.

(21) Appl. No.: 13/408,976

(22) Filed: Feb. 29, 2012

(65) Prior Publication Data

US 2013/0121495 A1 May 16, 2013

Related U.S. Application Data

(60) Provisional application No. 61/533,033, filed on Sep. 9, 2011.

(51) Int. Cl.
*G10L 21/0272* (2013.01)

(52) U.S. Cl.
CPC ..... *G10L 21/0272* (2013.01)

(58) Field of Classification Search
CPC ..... G10L 15/08; G10L 15/197; G10L 15/187; G11B 20/105; G11B 20/10527; G06F 3/16; H04N 11/00; G01H 3/14
USPC ..... 381/56, 71.1, 71.4, 41.11, 71.12, 71.13, 381/71.14, 60, 61, 20, 92, 94.2, 98, 122; 700/94; 706/14, 56; 704/255, 222, 232, 704/233, 236, 245, 268, 248, 500; 84/616, 84/608, 621, 682, 683, 691
See application file for complete search history.

(56) References Cited

U.S. PATENT DOCUMENTS

2010/0131086 A1 5/2010 Itoyama et al.

OTHER PUBLICATIONS

Guo et al, "Audio source separation by probabilistic latent component analysis", Dec. 7, 2010.*

Radhakrishnan, R., Xiong, Z., Otsuka, I., "A Content-Adaptive Analysis and Representation Framework for Audio Event Discovery from Unscripted Multimedia," EURASIP Journal on Applied Signal Processing, 1-24 (2006).

Smaragdis, P., Raj, B., Shashanka, M.: A probabilistic latent variable model for acoustic modeling. In Advances in models for acoustic processing, NIPS. (2006), 6 pages.

Smaragdis, P., Raj, B., Shashanka, M.: Supervised and Semi-Supervised Separation of Sounds from Single-Channel Mixtures. In proceedings of the 7th International Conference on Independent Component Analysis and Signal Separation. London, UK. Sep. 2007, 10 pages.

* cited by examiner

*Primary Examiner* — Vivian Chin
*Assistant Examiner* — David Ton
(74) *Attorney, Agent, or Firm* — Wolfe-SBMC

(57) ABSTRACT

A sound mixture may be received that includes a plurality of sources. A model may be received that includes a dictionary of spectral basis vectors for the plurality of sources. A weight may be estimated for each of the plurality of sources in the sound mixture based on the model. In some examples, such weight estimation may be performed using a source separation technique without actually separating the sources.

20 Claims, 11 Drawing Sheets

SOUND MIXTURE RECOGNITION

PRIORITY INFORMATION

This application claims benefit of priority of U.S. Provisional Application Ser. No. 61/533,033 entitled "Sound Mixture Recognition" filed Sep. 9, 2011, the content of which is incorporated by reference herein in its entirety.

BACKGROUND

In audio processing, most sounds are a mixture of various sound sources. For example, recorded music typically includes a mixture of overlapping parts played with different instruments. As another example, movies may include various classes of sounds, such as dialog, music, car sounds, etc., any of which may occur simultaneously. Also, in social environments, multiple people often tend to speak concurrently—referred to as the "cocktail party effect." In fact, even so-called single sources can actually be modeled a mixture of sound and noise.

The rapid increase of multimedia content calls for more efficient and better ways of browsing the content and searching for targeted scenes. In some respects, audio data (e.g., audio tracks in videos) is more efficient to process than video data, such as in sports highlight detection and movies (e.g., gun shots, car engine noise, music, etc.). For instance, audio has a lower bit-rate than video. Thus, audio data can be a useful browse and search tool. Possible ways to search and organize multimedia content includes: text description or tags, collaborative filtering, and content analysis. While the human auditory system has an extraordinary ability to differentiate between constituent sound sources, content analysis remains a difficult problem for computers.

SUMMARY

This disclosure describes techniques and structures for determining proportions of sources of a sound mixture. In one embodiment, a sound mixture may be received that includes a plurality of sources. A model may be received that includes a dictionary of spectral basis vectors for the plurality of sources. A weight may then be estimated for each of the plurality of sources in the sound mixture based on the model. In some examples, such weight estimation may be performed using a source separation technique without actually separating the sources.

In one non-limiting embodiment, the received model may be a composite model. The composite model may include a model corresponding to each source, with each model having its own dictionary (e.g., spectral basis vectors). Each of the models may also include a transition matrix that includes temporal information that represents a temporal dependency among the spectral basis vectors of that source. Estimating the weights may further include refining the estimated weights based on the transition matrix. Such estimating and refining may be performed iteratively, in some embodiments.

Figure 1:
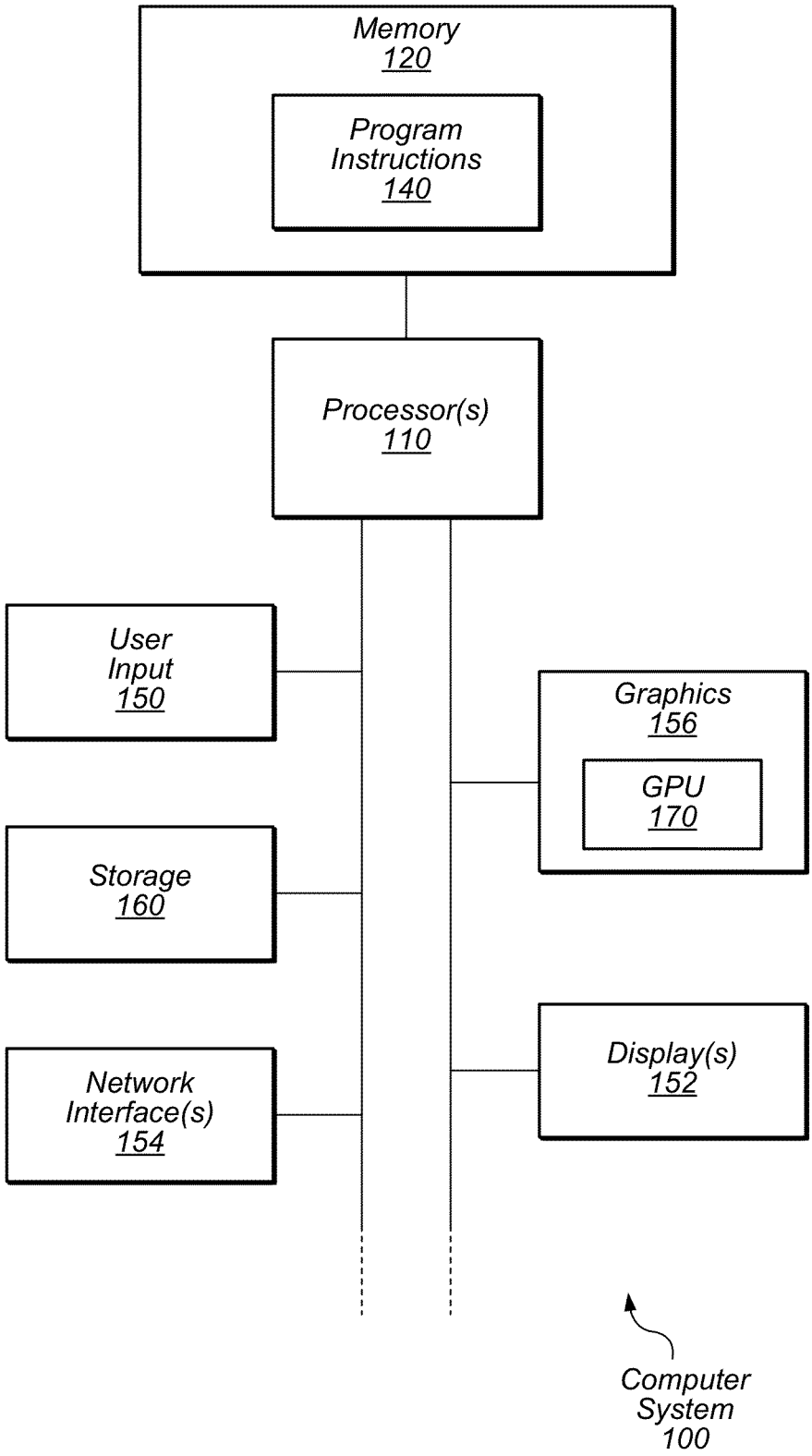
FIG. 1 is a block diagram of an illustrative computer system or device configured to implement some embodiments.

While this specification provides several embodiments and illustrative drawings, a person of ordinary skill in the art will recognize that the present specification is not limited only to the embodiments or drawings described. It should be understood that the drawings and detailed description are not intended to limit the specification to the particular form disclosed, but, on the contrary, the intention is to cover all modifications, equivalents and alternatives falling within the spirit and scope of the claims. The headings used herein are for organizational purposes only and are not meant to be used to limit the scope of the description. As used herein, the word "may" is meant to convey a permissive sense (i.e., meaning "having the potential to"), rather than a mandatory sense (i.e., meaning "must"). Similarly, the words "include," "including," and "includes" mean "including, but not limited to."

DETAILED DESCRIPTION OF EMBODIMENTS

In the following detailed description, numerous specific details are set forth to provide a thorough understanding of claimed subject matter. However, it will be understood by those skilled in the art that claimed subject matter may be practiced without these specific details. In other instances, methods, apparatuses or systems that would be known by one of ordinary skill have not been described in detail so as not to obscure claimed subject matter.

Some portions of the detailed description which follow are presented in terms of algorithms or symbolic representations of operations on binary digital signals stored within a memory of a specific apparatus or special purpose computing device or platform. In the context of this particular specification, the term specific apparatus or the like includes a general purpose computer once it is programmed to perform particular functions pursuant to instructions from program software. Algorithmic descriptions or symbolic representations are examples of techniques used by those of ordinary skill in the signal processing or related arts to convey the substance of their work to others skilled in the art. An algorithm is here, and is generally, considered to be a self-consistent sequence of operations or similar signal processing leading to a desired result. In this context, operations or processing involve physical manipulation of physical quantities. Typically, although not necessarily, such quantities may take the form of electrical or magnetic signals capable of being stored, transferred, combined, compared or otherwise manipulated. It has proven convenient at times, principally for reasons of common usage, to refer to such signals as bits, data, values, elements, symbols, characters, terms, numbers, numerals or the like. It should be understood, however, that all of these or similar terms are to be associated with appropriate physical quantities and are merely convenient labels. Unless specifically stated otherwise, as apparent from the following discussion, it is appreciated that throughout this specification discussions utilizing terms such as "processing," "computing," "calculating," "determining" or the like refer to actions or processes of a specific apparatus, such as a special purpose computer or a similar special purpose electronic computing device. In the context of this specification, therefore, a special purpose computer or a similar special purpose electronic computing device is capable of manipulating or transforming signals, typically represented as physical electronic or magnetic quantities within memories, registers, or other information storage devices, transmission devices, or display devices of the special purpose computer or similar special purpose electronic computing device.

"First," "Second," etc. As used herein, these terms are used as labels for nouns that they precede, and do not imply any type of ordering (e.g., spatial, temporal, logical, etc.). For example, for a signal analysis module estimating a weight of each of a plurality of sources in a sound mixture based on a model of the sources, the terms "first" and "second" sources can be used to refer to any two of the plurality of sources. In other words, the "first" and "second" sources are not limited to logical sources 0 and 1.

"Based On." As used herein, this term is used to describe one or more factors that affect a determination. This term does not foreclose additional factors that may affect a determination. That is, a determination may be solely based on those factors or based, at least in part, on those factors. Consider the phrase "determine A based on B." While B may be a factor that affects the determination of A, such a phrase does not foreclose the determination of A from also being based on C. In other instances, A may be determined based solely on B.

"Signal." Throughout the specification, the term "signal" may refer to a physical signal (e.g., an acoustic signal) and/or to a representation of a physical signal (e.g., an electromagnetic signal representing an acoustic signal). In some embodiments, a signal may be recorded in any suitable medium and in any suitable format. For example, a physical signal may be digitized, recorded, and stored in computer memory. The recorded signal may be compressed with commonly used compression algorithms. Typical formats for music or audio files may include WAV, OGG, RIFF, RAW, AU, AAC, MP4, MP3, WMA, RA, etc.

"Source." The term "source" refers to any entity (or type of entity) that may be appropriately modeled as such. For example, a source may be an entity that produces, interacts with, or is otherwise capable of producing or interacting with a signal. In acoustics, for example, a source may be a musical instrument, a person's vocal cords, a machine, etc. In some cases, each source—e.g., a guitar—may be modeled as a plurality of individual sources—e.g., each string of the guitar may be a source. In other cases, entities that are not otherwise capable of producing a signal but instead reflect, refract, or otherwise interact with a signal may be modeled as a source—e.g., a wall or enclosure. Moreover, in some cases two different entities of the same type—e.g., two different pianos—may be considered to be the same "source" for modeling purposes.

"Mixed signal," "Sound mixture." The terms "mixed signal" or "sound mixture" refer to a signal that results from a combination of signals originated from two or more sources into a lesser number of channels. For example, most modern music includes parts played by different musicians with different instruments. Ordinarily, each instrument or part may be recorded in an individual channel. Later, these recording channels are often mixed down to only one (mono) or two (stereo) channels. If each instrument were modeled as a source, then the resulting signal would be considered to be a mixed signal. It should be noted that a mixed signal need not be recorded, but may instead be a "live" signal, for example, from a live musical performance or the like. Moreover, in some cases, even so-called "single sources" may be modeled as producing a "mixed signal" as mixture of sound and noise.

Introduction

This specification first presents an illustrative computer system or device, as well as an illustrative signal analysis module that may implement certain embodiments of methods disclosed herein. The specification then discloses techniques for estimating sound mixture weights from various sound sources. Various examples and applications are also disclosed. Some of these techniques may be implemented, for example, by a signal analysis module or computer system.

In some embodiments, these techniques may be used in music recording and processing, source extraction, noise reduction, teaching, automatic transcription, electronic games, audio search and retrieval, video search and retrieval, audio and/or video organization, and many other applications. As one non-limiting example, the techniques may allow for frames of a video and/or audio clip to be searched for a particular sound source (e.g., car noise). Although certain embodiments and applications discussed herein are in the field of audio, it should be noted that the same or similar principles may also be applied in other fields.

Example System

FIG. 1 is a block diagram showing elements of an illustrative computer system 100 that is configured to implement embodiments of the systems and methods described herein. The computer system 100 may include one or more processors 110 implemented using any desired architecture or chip set, such as the SPARC™ architecture, an x86-compatible architecture from Intel Corporation or Advanced Micro Devices, or an other architecture or chipset capable of processing data. Any desired operating system(s) may be run on the computer system 100, such as various versions of Unix, Linux, Windows® from Microsoft Corporation, MacOS® from Apple Inc., or any other operating system that enables the operation of software on a hardware platform. The processor(s) 110 may be coupled to one or more of the other illustrated components, such as a memory 120, by at least one communications bus.

In some embodiments, a specialized graphics card or other graphics component 156 may be coupled to the processor(s) 110. The graphics component 156 may include a graphics processing unit (GPU) 170, which in some embodiments may be used to perform at least a portion of the techniques described below. Additionally, the computer system 100 may include one or more imaging devices 152. The one or more imaging devices 152 may include various types of raster-based imaging devices such as monitors and printers. In an embodiment, one or more display devices 152 may be coupled to the graphics component 156 for display of data provided by the graphics component 156.

In some embodiments, program instructions 140 that may be executable by the processor(s) 110 to implement aspects of the techniques described herein may be partly or fully resident within the memory 120 at the computer system 100 at any point in time. The memory 120 may be implemented using any appropriate medium such as any of various types of ROM or RAM (e.g., DRAM, SDRAM, RDRAM, SRAM, etc.), or combinations thereof. The program instructions may also be stored on a storage device 160 accessible from the processor(s) 110. Any of a variety of storage devices 160 may be used to store the program instructions 140 in different embodiments, including any desired type of persistent and/or volatile storage devices, such as individual disks, disk arrays, optical devices (e.g., CD-ROMs, CD-RW drives, DVD-ROMs, DVD-RW drives), flash memory devices, various types of RAM, holographic storage, etc. The storage 160 may be coupled to the processor(s) 110 through one or more storage or I/O interfaces. In some embodiments, the program instructions 140 may be provided to the computer system 100 via any suitable computer-readable storage medium including the memory 120 and storage devices 160 described above.

The computer system 100 may also include one or more additional I/O interfaces, such as interfaces for one or more user input devices 150. In addition, the computer system 100 may include one or more network interfaces 154 providing access to a network. It should be noted that one or more components of the computer system 100 may be located remotely and accessed via the network. The program instructions may be implemented in various embodiments using any desired programming language, scripting language, or combination of programming languages and/or scripting languages, e.g., C, C++, C#, Java™, Perl, etc. The computer system 100 may also include numerous elements not shown in FIG. 1, as illustrated by the ellipsis.

A Signal Analysis Module

Figure 2:
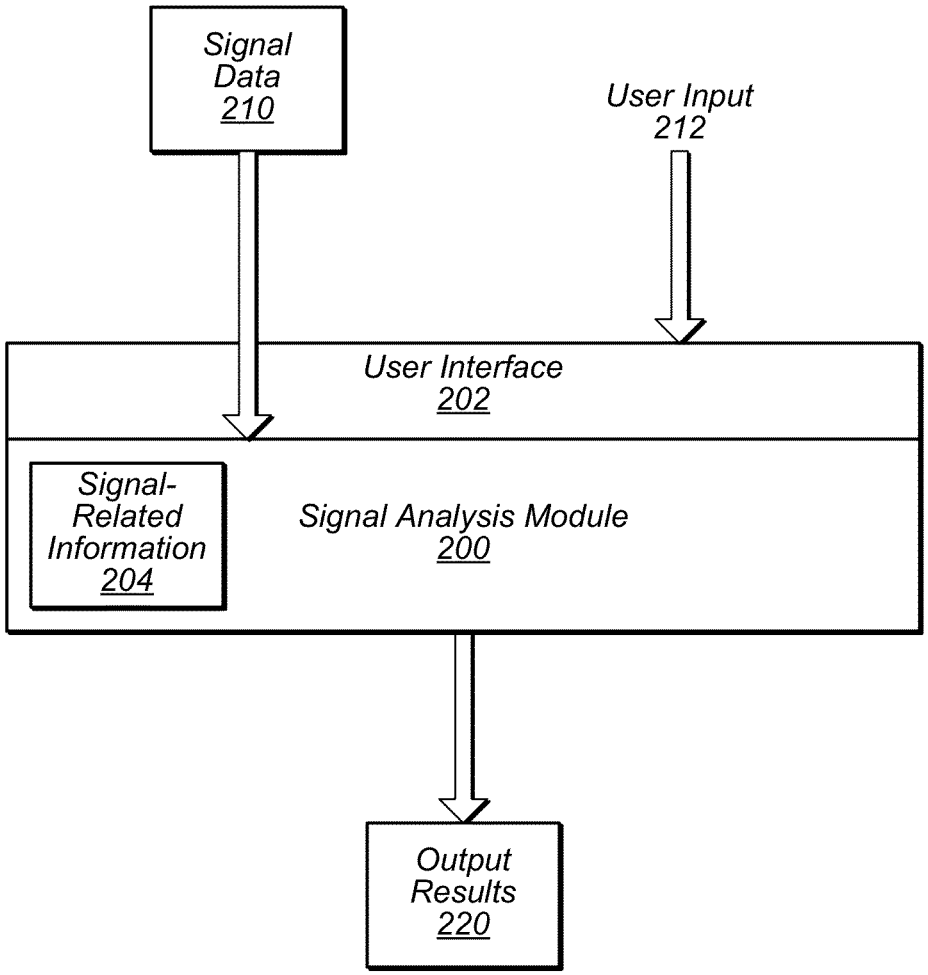
FIG. 2 is a block diagram of an illustrative signal analysis module, according to some embodiments.

In some embodiments, a signal analysis module may be implemented by processor-executable instructions (e.g., instructions 140) stored on a medium such as memory 120 and/or storage device 160. FIG. 2 shows an illustrative signal analysis module that may implement certain embodiments disclosed herein. In some embodiments, module 200 may provide a user interface 202 that includes one or more user interface elements via which a user may initiate, interact with, direct, and/or control the method performed by module 200. Module 200 may be operable to obtain digital signal data for a digital signal 210, receive user input 212 regarding the signal data, analyze the signal data and/or the input, and output analysis results 220 for the signal data 210. In an embodiment, the module may include or have access to additional or auxiliary signal-related information 204—e.g., a collection of representative signals, model parameters, etc. Output analysis results 220 may include mixture weights (e.g., proportions) of the constituent sources of signal data 210.

Signal analysis module 200 may be implemented as or in a stand-alone application or as a module of or plug-in for a signal processing application. Examples of types of applications in which embodiments of module 200 may be implemented may include, but are not limited to, signal (including sound) analysis, characterization, search, processing, and/or presentation applications, as well as applications in security or defense, educational, scientific, medical, publishing, broadcasting, entertainment, media, imaging, acoustic, oil and gas exploration, and/or other applications in which signal analysis, characterization, representation, or presentation may be performed. Module 200 may also be used to display, manipulate, modify, classify, and/or store signals, for example to a memory medium such as a storage device or storage medium.

Figure 3:
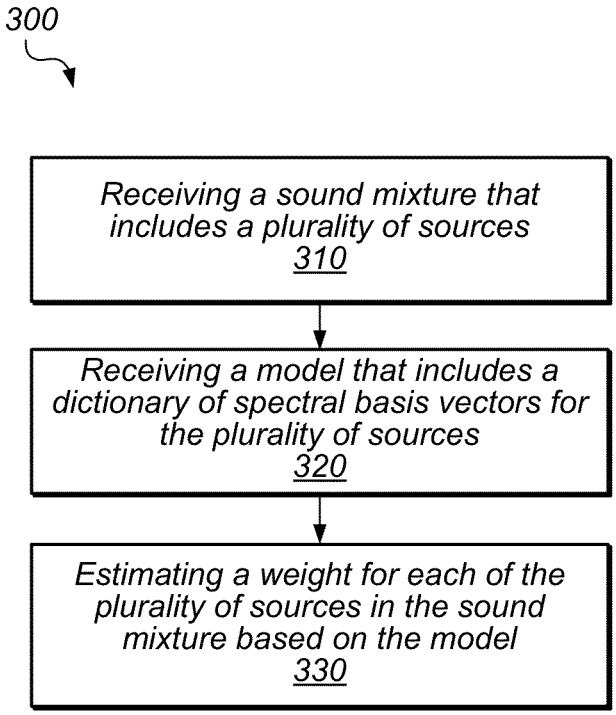
FIG. 3 is a flowchart of a method for sound mixture recognition, according to some embodiments.

Turning now to FIG. 3, one embodiment of sound mixture recognition is illustrated. While the blocks are shown in a particular order for ease of understanding, other orders may be used. In some embodiments, method 300 of FIG. 3 may include additional (or fewer) blocks than shown. Blocks 310-330 may be performed automatically, may receive user input, or may use a combination thereof. In some embodiments, one or more of blocks 310-330 may be performed by signal analysis module 200 of FIG. 2.

As illustrated at 310, a sound mixture that includes a plurality of sound sources may be received. Example classes of sound sources may include: speech, music, gunshots, applause, car engine, etc. Accordingly, examples of sound mixtures may include: speech and music, speech and a car engine, gunshots and music, etc. In some examples, each source (e.g., a guitar) may be modeled as a plurality of individual sources, such as each string of the guitar being modeled as a source. In various embodiments, the sound classes that may be analyzed in method 300 may be pre-specified. For instance, in some embodiments, method 300 may only recognize sources that have been pre-specified. Sources may be pre-specified, for example, based on received user input. The received sound mixture may be in the form of a spectrogram of signals emitted by the respective sources corresponding to each of the plurality of sound classes. In other scenarios, a time-domain signal may be received and processed to produce a time-frequency representation or spectrogram. In some embodiments, the spectrograms may be spectrograms generated, for example, as the magnitudes of the short time Fourier transform (STFT) of the signals. The signals may be previously recorded or may be portions of live signals received at signal analysis module 200. Note that not all sound sources of the received sound mixture may be present at one time (e.g., in one frame). For example, in one time frame, speech and music may be present while, at another time, music and applause may be present.

As shown at 320, a model may be received for each of the plurality of sound classes. In some embodiments, the models for each source may be received as a single composite model. In one embodiment, the models may be generated by signal analysis module 200, and may include generating a spectrogram for each sound class. In other embodiments, another component, which may be from a different computer system, may generate the models. Yet in other embodiments, the models may be received as user input. The spectrogram of each sound class may be viewed as a histogram of sound quanta across time and frequency. Each column of a spectrogram may be the magnitude of the Fourier transform over a fixed window of an audio signal. As such, each column may describe the spectral content for a given time frame (e.g., 50 ms, 100 ms, 150 ms, etc.). In some embodiments, the spectrogram may be modeled as a linear combination of spectral vectors from a dictionary using a factorization method.

In some embodiments, a factorization method may include two sets of parameters. A first set of parameters, $P(f|z)$, is a distribution of frequencies for latent component z, and may be viewed as a spectral vector from a dictionary. A second set of parameters, $P(z_t)$, is a distribution of weights for the aforementioned dictionary elements at time t. Given a spectrogram, these parameters may be estimated using an Expectation-Maximization (EM) algorithm or some other suitable algorithm.

The models may include the spectral structure and temporal dynamics of each source, or sound class. As described herein, each of the sound classes may be pre-specified. Moreover, in generating the models, isolated training data for each sound class may be used. The training data may be obtained and/or processed at a different time than blocks 310-330 of method 300. For instance, the training data may, in some instances, be prerecorded. Given the training data, a model may be generated for each sound class. A small amount of training data may generalize well for some sound classes whereas for others, it may not. Accordingly, the amount of training data used to generate a respective model may vary from class to class. Moreover, the size of the respective model may likewise vary from class to class. In some embodiments, receiving the training data for each sound class, generating the model(s), and/or specifying the sound classes may be performed as part of method 300.

Each model may include a dictionary of spectral basis vectors and, in some embodiments, a transition matrix. The transition matrix may include temporal information that represents a temporal dependency among the spectral basis vectors. Each of respective models for each sound class may be combined into a composite model that is received at 320. The composite model may include a composite dictionary and a composite transition matrix. The composite dictionary may include the dictionary elements (e.g., spectral basis vectors) from each of the respective dictionaries. For example, the dictionary elements may be concatenated together into the single composite dictionary. If a first dictionary, corresponding to source 1, has 15 basis vectors and a second dictionary, corresponding to source 2, has 15 basis vectors, the composite dictionary may have 30 basis vectors, corresponding to those from each of the first and secondary dictionaries. Elements from each respective transition matrix may likewise be concatenated into the composite transition matrix, which may be referred to as a joint transition matrix.

Each dictionary may include a plurality of spectral components of the spectrogram. For example, the dictionary may include a number of basis vectors (e.g., 1, 3, 8, 12, 15, etc.). Each segment of the spectrogram may be represented by a linear combination of spectral components of the dictionary. The spectral basis vectors and a set of weights may be estimated using a source separation technique. Example source separation techniques include probabilistic latent component analysis (PLCA), non-negative hidden Markov model (N-HMM), and non-negative factorial hidden Markov model (N-FHMM). For additional details on the N-HMM and N-FHMM algorithms, see U.S. patent application Ser. No. 13/031,357, filed Feb. 21, 2011, entitled "Systems and Methods for Non-Negative Hidden Markov Modeling of Signals", which is hereby incorporated by reference. Moreover, in some cases, each source may include multiple dictionaries. As a result of the generated dictionary, the training data may be explained as a linear combination of the basis vectors of the dictionary.

Elaborating on an example using an asymmetric version of PLCA, each time frame of a spectrogram may be modeled as a linear combination of dictionary elements as:

$$X(f,t) \approx \gamma \sum_{z} P(f|z)P_t(z) \tag{1}$$

where X(f,t) is the audio spectrogram, z is a latent variable, each P(f|z) is a dictionary element, $P_t(z)$ is a distribution of weights at time t, and γ is a constant scaling factor. All of the distributions may be discrete. Given X(f,t), the parameters of P(f|z) and $P_t(z)$ may be estimated using the EM algorithm. In one embodiment, a spectrogram $X_s(f,t)$ may be computed given isolated training data of source s. Equation (1) may then be used to estimate a set of dictionary elements and weights that correspond to that source. In one embodiment, it may be assumed that a single source is characterized by the dictionary elements. In such an embodiment, the dictionary elements may be retained while discarding the weights. Using the dictionary elements from each single source, a larger dictionary may be built to represent a mixture spectrogram, which may be formed, in one embodiment, by concatenating the dictionaries of the individual sources.

In other embodiments, the weights may not be discarded. Although the weights may be specific to the training data from which the dictionary elements and weights were derived, certain information may nevertheless be useful in the disclosed techniques. One such piece of information may be temporal dependencies amongst dictionary elements. For example, if a dictionary element is quite active in one time frame, it may be likely that the same dictionary element is quite active in the following time frame as well. Another example of a dependency that may exist may be that a high presence of dictionary element m in time frame t is usually followed by a high presence of dictionary element n in time frame t+1. Using the weights of adjacent time frames, such information may be determined, or inferred. For time frames t and t+1 of source s, the dependency may be computed as follows:

$$\phi_s(z_t, z_{t+1}) = P(z_t)P(z_{t+1}), \forall z \in z_s. \tag{2}$$

Equation (2) may give the affinity of each dictionary element to each other dictionary element in two adjacent time frames. If the value is averaged over all time frames and then normalized, a set of conditional probability distributions that serve as a transition matrix may be:

$$P_s(z_{t+1}|z_t) = \frac{\sum_{t=1}^{T-1} \phi_s(z_t, z_{t+1})}{\sum_{z_t+1} \sum_{t=1}^{T-1} \phi_s(z_t, z_{t+1})}. \tag{3}$$

Where dictionaries are learned from isolated training data, a transition matrix may be learned for each source. As a result, in some embodiments, the model for each source may include a dictionary and a transition matrix.

Figure 4:
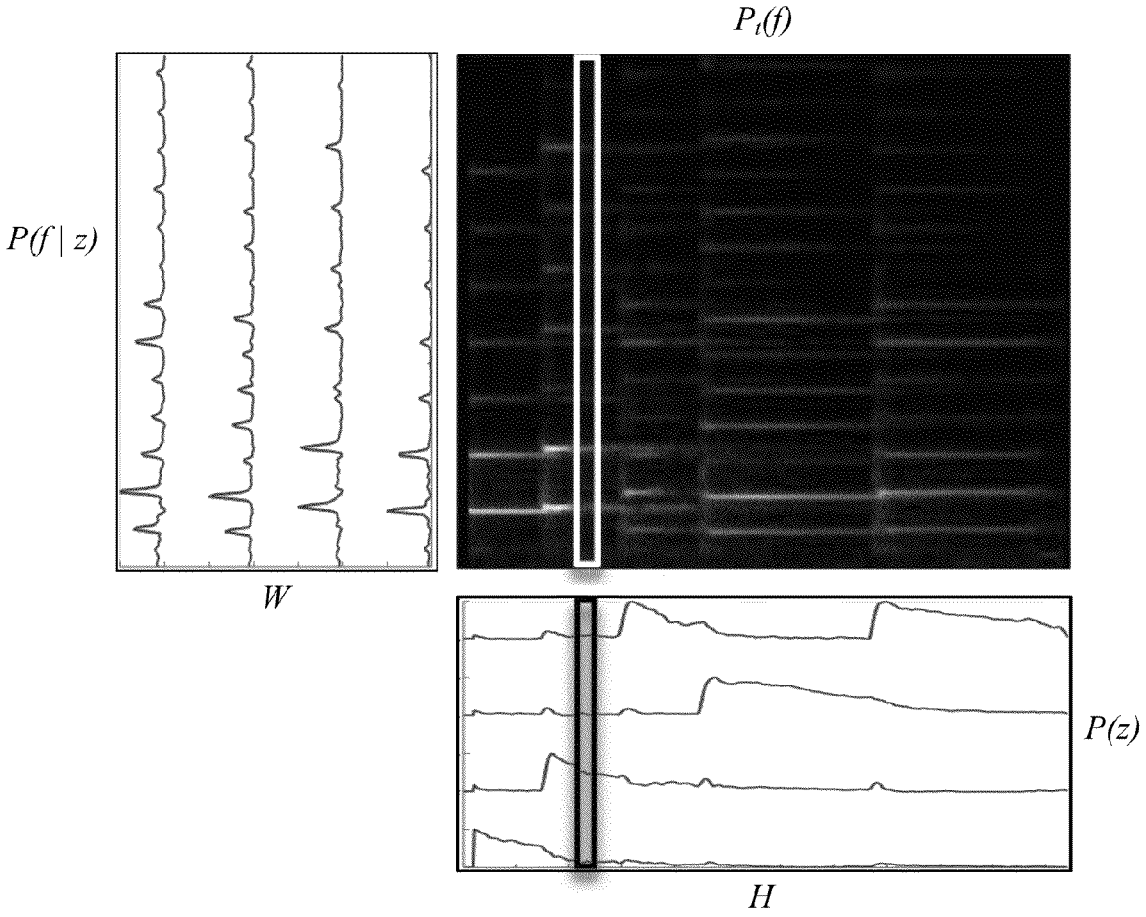
FIG. 4 illustrates an example model of a sound class using probabilistic latent component analysis (PLCA), according to some embodiments.
Figure 5:
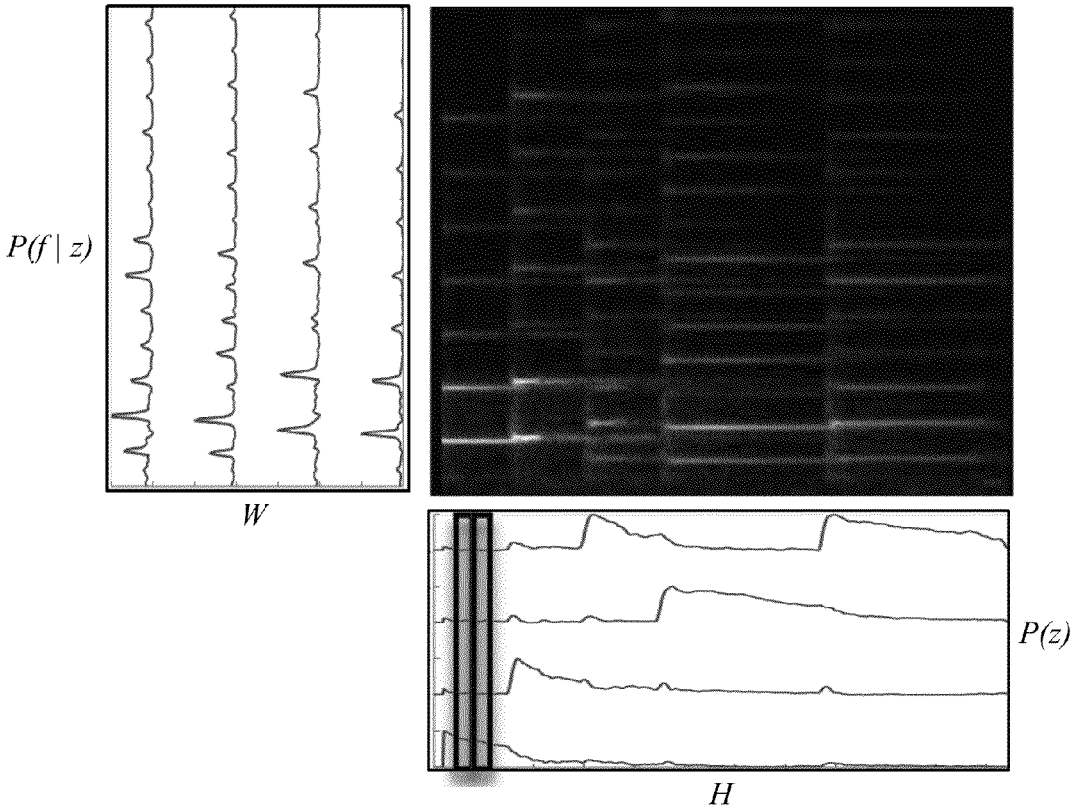
FIG. 5 illustrates learning temporal dependency among elements of the spectral basis from the weight, according to some embodiments.
Figure 6:
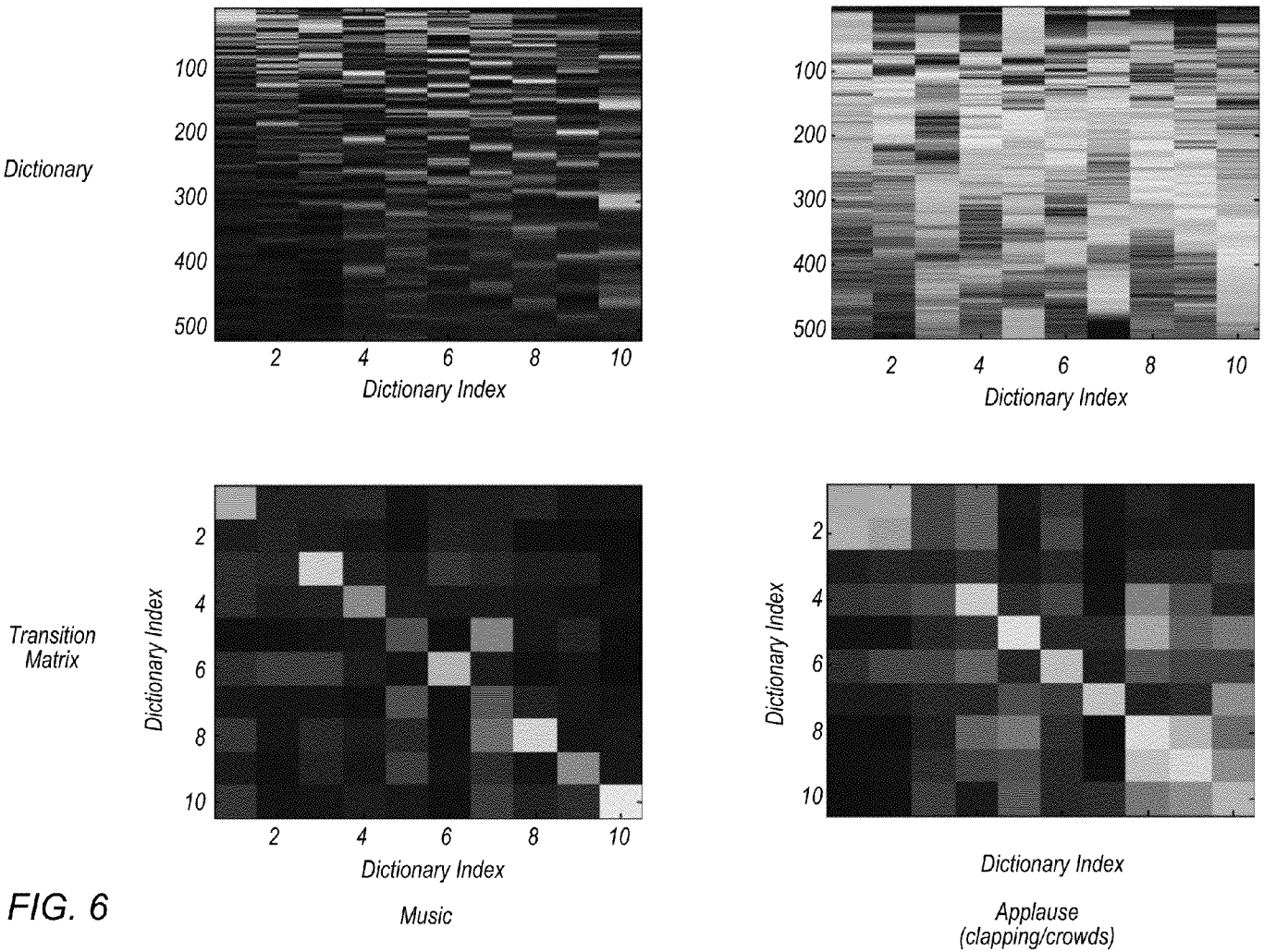
FIG. 6 illustrates example dictionaries and temporal transition matrices, according to some embodiments.

In one embodiment, the transition matrix may be estimated using the weights estimated using the source separation technique. FIGS. 4-6 illustrate example dictionaries and transition matrices, as W and H respectively. Note that the examples of FIGS. 4-6 may use slightly different notation for various terms (e.g., W for the dictionary and H for temporal weights) than in other portions of the disclosure.

FIG. 4 illustrates an example model of a sound source/class (e.g., speech, music, etc.), according to some embodiments. In one embodiment, a single class of sounds may be defined as x(t). A basic audio representation may be in the form of a magnitude spectrogram: $x(t) \rightarrow X_t(f)$. Each spectrogram frame, as shown in FIG. 4, may be normalized as $$\hat{X}_t(f) = \frac{X_t(f)}{\sum X_t(f')} = P_t(f).$$

A source separation algorithm may then be applied. For example, a probabilistic latent component analysis (PLCA), or non-negative factorization algorithm, may be applied giving: $P_t(f) = \Sigma P(f|z)Pt(z) \rightarrow V = W \cdot H$, where W is the spectral basis (dictionary) and H is the temporal weight. In other embodiments, other algorithms may be used. For instance, the N-HMM and N-FHMM algorithms may be used.

As illustrated, each dictionary has one or more elements, such as spectral basis vectors. The variable f indicates a frequency or frequency band. The spectral vector z may be defined by the distribution P(f|z). It should be noted that there may be a temporal aspect to the model, as indicated by t. The given magnitude spectrogram at a time frame is modeled as a linear combination of the spectral vectors of the corresponding dictionary. At time t, the weights may be determined by the distribution $P_t(f)$. The corresponding temporal weights in the frequency domain may be seen in FIG. 4 as $P_t(z)$. In one embodiment, dictionary elements and their respective weights may be estimated in the M step of the EM algorithm, as follows:

$$P(f|z) = \frac{\sum_t V_{ft} P_t(z|f)}{\sum_t \sum_f V_{ft} P_t(z|f)}$$

$$P_t(z) = \frac{\sum_f V_{ft} P_t(z|f)}{\sum_z \sum_f V_{ft} P_t(z|f)}$$

Note once again that these equations are alternative representations for the dictionary elements and weights and that the same dictionary elements and weights may be expressed in other notation, as described herein.

As described herein, the transition matrix may indicate probabilities of transition between dictionaries. Temporal dependencies among elements of the spectral basis may be learned from the weights, as shown in FIG. 5. Note the rectangular regions in P(z) indicating temporal dependency. In one embodiment, the transition matrix may force temporal coherency in the models. Using an alternative notation, the temporal dependency may then be parameterized with a transition matrix as follows:

$$T_0 = H(:,[1:N-1])H(:,[2:N])^T$$

$$T = T_0/\mathrm{sum}(T_0,2)$$

An example dictionary and corresponding transition matrix for each music and applause, respectively, is shown in FIG. 6. As shown, transition matrices may vary depending on source. For example, music may typically have smooth transitions whereas applause or other abrupt noises may not be as smooth.

In some embodiments, the sound class models may also include parameters such as, mixture weights, initial state probabilities, energy distributions, etc. These parameters may be obtained, for example, using an EM algorithm or some other suitable method.

Turning back to FIG. 3, the received sound mixture may be modeled as a combination of sound classes, or sources. In some embodiments, the mixture spectrum may be modeled as a linear combination of individual sources, which in turn may each be modeled as a linear combination of spectral vectors from their respective dictionaries. This allows modeling the mixture as a linear combination of the spectral vectors from the given pair of dictionaries. In one embodiment, sound mixtures may be modeled with the underlying assumption that $y(t)=x_1(t)+x_2(t) \rightarrow Y_t(f)=X_{1,t}(f)+X_{2,t}(f)$. Then, a mixture of two sources may be modeled linearly in the spectral domain as $\hat{Y}_t(f)=W_1 \cdot H_1+W_2 \cdot H_2$. Even more generally, a mixture of sound may be modeled with N classes of sounds: $\hat{Y}_t(f)=W_1 \cdot H_1+W_2 \cdot H_2+W_3 \cdot H_3+ \ldots +W_N \cdot H_N$.

Figure 7:
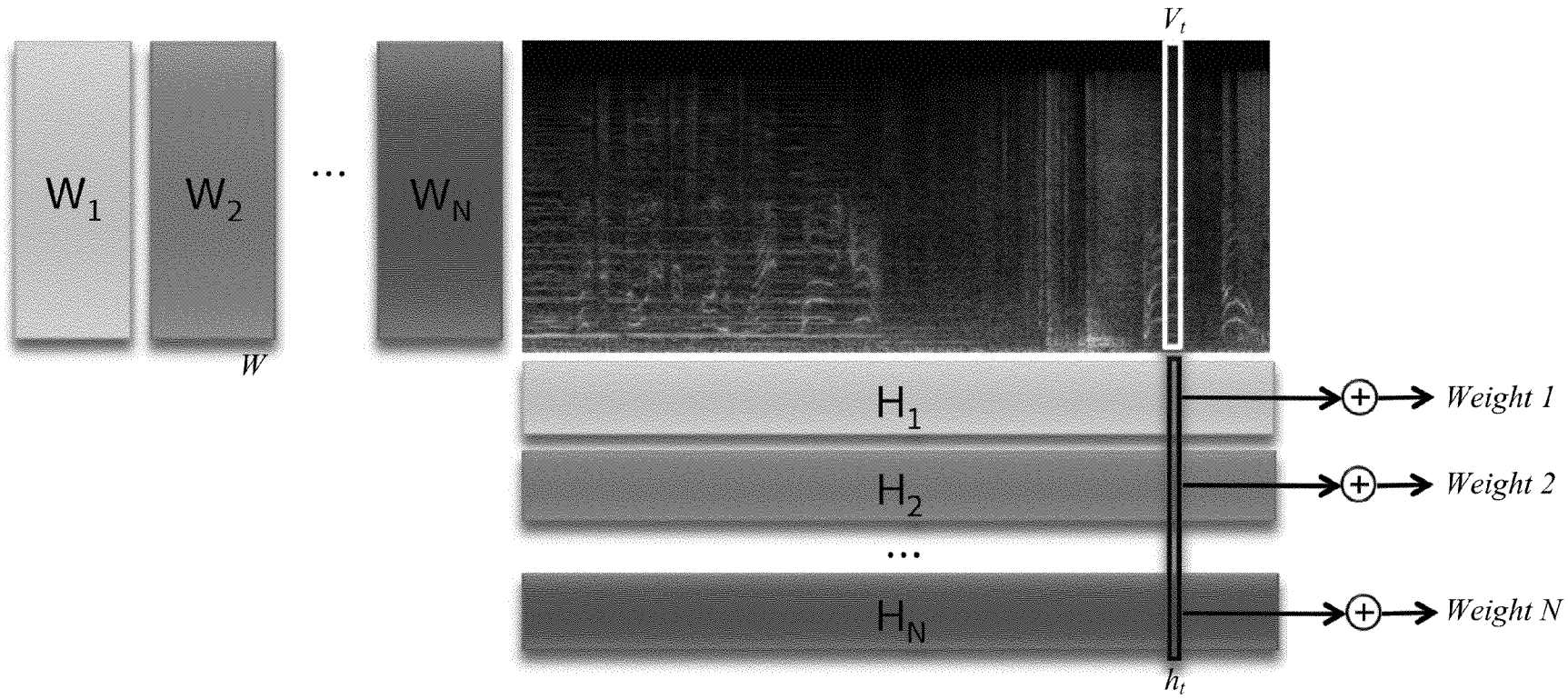
FIG. 7 illustrates an example of mixture weight estimation, according to some embodiments.

As shown at 330, weights, or proportions, of the sources of the sound mixture may be estimated for each of the plurality of sources based on the generated models. In one embodiment, a proportion of each sound class may be estimated at each time frame of the sound mixture. In some embodiments, the proportions may be estimated using a source separation algorithm (e.g., PLCA, etc.). In one embodiment, the relative proportion of each source may be estimated using such a source separation algorithm with actually separating the sources. By not actually separating the sources, usage of the source separation algorithm may be optimized for sound recognition/source estimation instead of for source separation. For example, dictionary sizes may be selected to optimize source estimation performance, the sizes of which may not be optimal for actual source separation. The estimates may be refined, in some embodiments, using temporal information from the transition matrix. An illustration of mixture weight estimation is shown in FIG. 7. W represents the learned dictionaries from N classes of sounds. The equation $v_t=Wh_t$ may then be solved for a frame given a frame of mixture sounds, $v_t$, and the combined dictionaries, W. In one embodiment, weight 1, weight 2, to weight N may sum to a total of 1. Thus, in such an embodiment, the weights may be a proportion of each sound class. For instance, consider a scenario in which the output weights are 0.6 for sound class speech, 0.3 for sound class music, and 0.1 for sound class car noise. The resulting weights in that scenario sum to a total of 1, 60% for speech, 30% for music, and 10% for car noise. In other embodiments, raw weights may total more than 1 and a proportion may be determined. For example, output weights may be 1.2 for sound class speech, 0.6 for sound class music, and 0.2 for sound class car noise. In such an example, the same proportions, 60%, 30%, and 10% may be determined as in the previous example.

Elaborating on the example above using an asymmetric version of PLCA, consider a spectrogram $X_M(f,t)$ that is a mixture of two sources. $X_M(f,t)$ may be modeled as:

$$X_M(f,t) \approx \gamma \sum_{z \in \{z_{s1}, z_{s2}\}} P(f|z) P_t(z) \tag{3}$$

where $z_{s1}$ and $z_{s2}$ represent the dictionary elements that belong to source 1 and source 2, respectively. Although $X_M(f,t)$ is shown having two sources for ease of explanation, $X_M(f,t)$ may include more than two sources. Because the dictionary elements of both sources are already known, they may be kept fixed and the weights $P_t(z)$ may be estimated at each time using the EM algorithm. The weights may be the relative proportion of each dictionary element in the mixture. Accordingly, the relative proportions of the sources at each time frame may be computed by summing the corresponding weights as follows:

$$r_t(s_1) = \sum_{z \in z_{s1}} P_t(z)$$

$$r_t(s_2) = \sum_{z \in z_{s2}} P_t(z)$$

In some embodiments, mixture weights may be refined by using a transition matrix, such as a joint transition matrix $P(z_{t+1}|z_t)$ that corresponds to the concatenated dictionaries. Because it may be assumed that the activity of the dictionary elements in one dictionary is independent of that in other dictionaries, the joint transition matrix may be constructed by diagonalizing individual transition matrices. For example, in a scenario having two sound sources and two corresponding transition matrices T1 and T2, the joint transition matrix may be formed as:

$$T = \begin{bmatrix} T_1 & 0 \\ 0 & T_2 \end{bmatrix}.$$

Given the received sound mixture from block 310, the weights $P_t(z)$ may be estimated, as described herein. That estimation may be referred to as the initial weights estimates $P_t^{(i)}(z)$. Using the initial weights estimates, a new estimate of the weights may be determined based on the joint transition matrix (e.g., based on dependencies from the joint transition matrix). One way of determining the new estimates is to compute re-weighting terms in the forward and backward directions to impose the joint transition matrix in both directions:

$$F_{t+1}(z) = \sum_{z_t} P(z_{t+1}|z_t)P_t^{(i)}(z)$$

$$B_t(z) = \sum_{z_{t+1}} P(z_{t+1}|z_t)P_{t+1}^{i}(z)$$

Using the re-weighting terms, the re-weighting may be performed and normalized resulting in the following final estimate of the weights:

$$P_t(z) = \frac{P_t^{(i)}(z)(C + F_t(z) + B_t(z))}{\sum_z P_t^{(i)}(z)(C + F_t(z) + B_t(z))}$$

where C is a parameter that controls the influence of the joint transition matrix. As C tends to infinity, the effect of the forward and backward re-weighting terms becomes negligible, whereas as C tends to 0, the estimates $P_t^{(i)}(z)$ may be modulated by the predictions of the two terms $F_{t+1}(z)$ and $B_t(z)$, thereby imposing the expected structure. This re-weighting may be performed after the M step in every EM iteration. The relative proportions of single sources at each time frame may be determined by summing the corresponding weights $r_t(s_1)$ and $r_t(s_2)$.

Described in another way using alternative notation, H may be estimated by using a source separation technique, such as PLCA, given W and the test data. At each EM iteration, regularization terms may be added to the estimated H, as indicated in the following equations:

$$H_F(:,t+1) \leftarrow H(:,t+1)(C+T^T H(:,t))$$

$$H_B(:,t) \leftarrow H(:,t)(C+TH(:,t+1))$$

$$H = H_F + H_B$$

This technique may be described as a bilateral filtering that is performed forward and backward in time.

Figure 9:
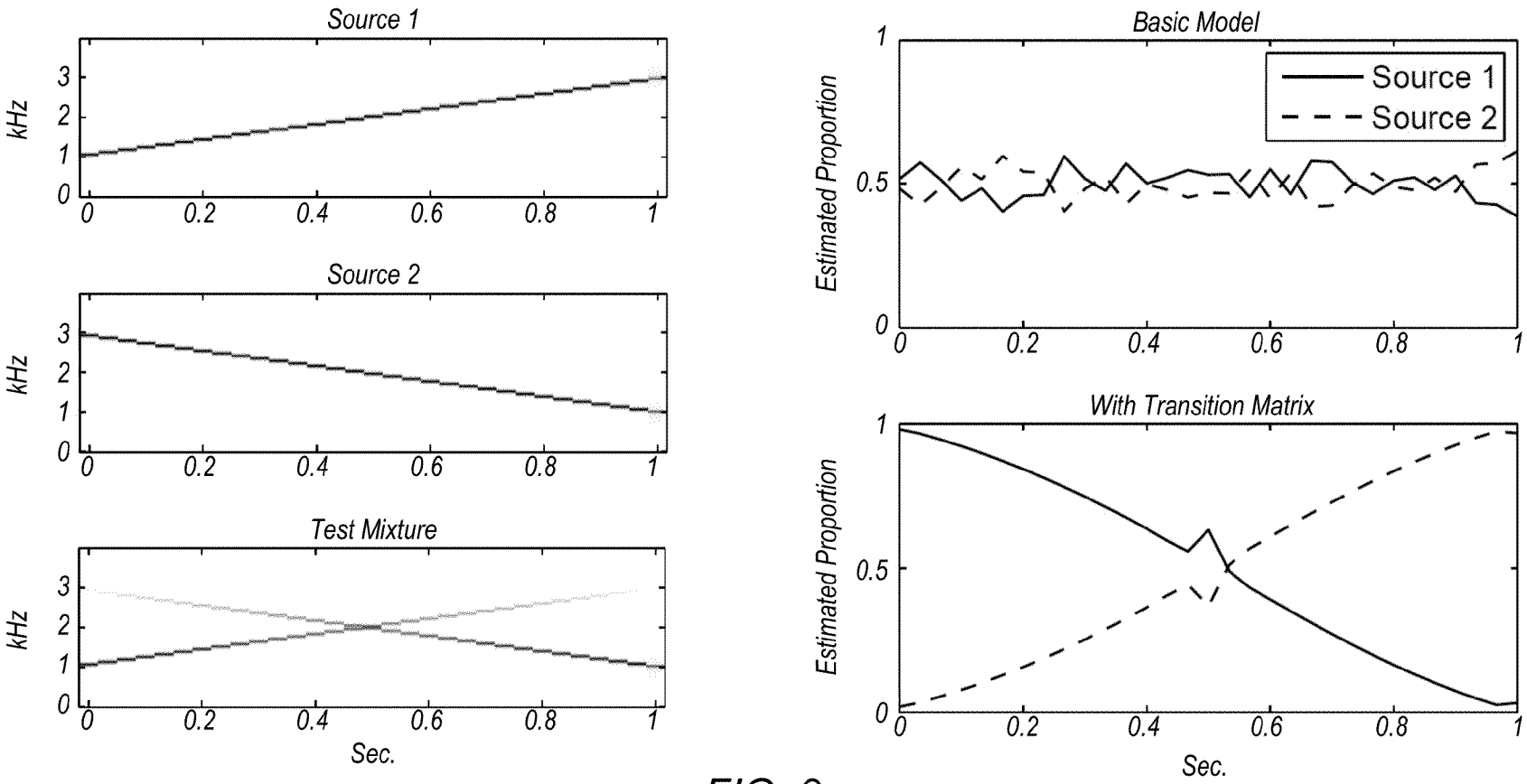
FIG. 9 illustrates example weight estimations, according to some embodiments.

Using the transition matrix may take advantage of patterns of the sound sources. For example, for a source whose model has a dictionary of 15 basis vectors, it may be determined from the training data that if a frame has a large amount of basis vector 5, then the next frame typically has a large amount of basis vector 7 and rarely has a large amount of basis vector 13. As another example, certain sound classes (e.g., music) may typically include highly correlated adjacent frames resulting in smoother transitions, whereas for other sound classes (e.g., gun shots), adjacent frames may have little correlation. Using a transition matrix may leverage such information to create more precise weight estimations. FIG. 9 described below, illustrates an example of an effect of using a transition matrix.

In some embodiments, the estimating and refining of block 330 may be performed iteratively. For example, the estimating and refining may be performed in multiple iterations of an EM algorithm. The iterations may continue for a certain number of iterations or until a convergence. A weight may be converged when the change in weight from one iteration to another is less than some threshold.

In various embodiments, the mixture weights may be used as confidence scores as to the presence of a sound class in a particular frame of an audio and/or video source. As one example, one or more proportion thresholds (e.g., 60% and 15%) may be used. For instance, if a given sound class is found to make up 60% of the given time frame, then that sound class may be deemed to be present in that time frame, whereas if the given sound class is found to make up, for example, less than 15%, then the given sound class may be deemed as not present in that time frame.

Method 300 may provide useful information that may be used in a variety of applications, such as a search tool. For example, content may be processed according to method 300, with the resulting estimated weights being stored as metadata of a content file (or otherwise associated with the content). The metadata of such files may be searched according to the weights. As one example, consider a scenario in which a user wishes to search for a movie scene with Actor A, Actress B, with at least some car noise and at least some speech. The estimated weights associated with various content files may be searched (e.g., by a search tool) resulting in movie scenes that include the searched for sound mixture (and any other search terms, such as Actor A and Actress B).

Figure 8:
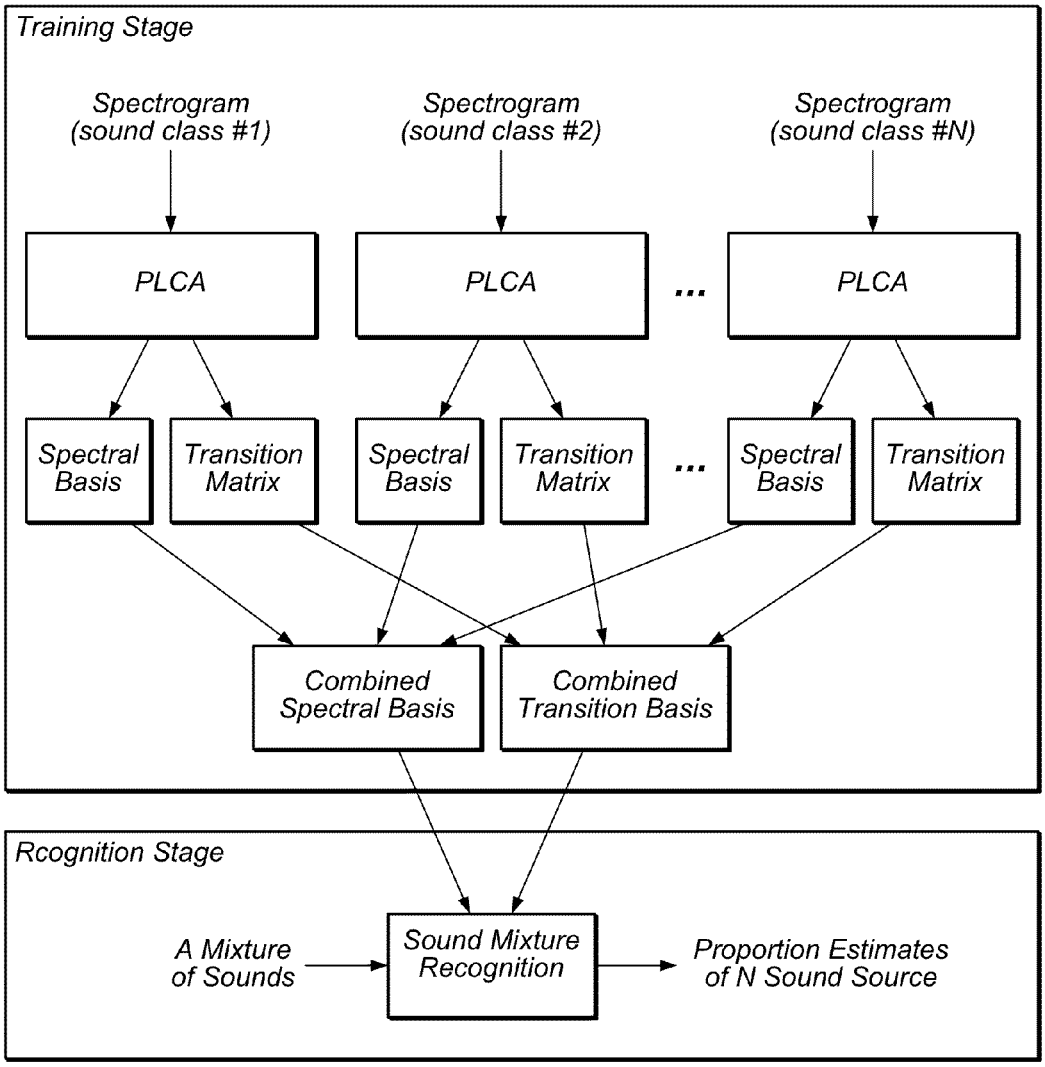
FIG. 8 is a block diagram of training and recognition stages of mixture weight estimation, according to some embodiments.

FIG. 8 depicts an example block diagram of training and recognition stages of mixture weight estimation according to some embodiments. As depicted, the modeling is performed during a training stage, which may occur offline at a different time than the depicted recognition stage. As shown, a spectrogram may be processed by an algorithm, such as PLCA, for each of N sound classes. The result of the PLCA process may be a spectral basis (dictionary) and a transition matrix. Each of those may be combined, respectively, into a combined spectral basis and a combined transition matrix. The recognition stage depicts receiving a mixture of sounds being recognized based on the combined spectral basis and combined transition matrix. As a result, proportion estimates of each of the N sources may be output.

EXAMPLES

FIG. 9 illustrates example weight estimations, according to some embodiments. FIG. 9 illustrates an example effect of re-weighting by the transition matrix. In the example, two source signals are given as chirps that have frequencies changing in opposite directions. Accordingly, the two source signals in the example have the same dictionary but different transition matrices. The test signal was created by cross-fading the two chirps. The model may estimate approximately the same proportions of the two sources because both dictionaries may explain the mixture equally well at each time frame. As shown, re-weighting using the transition matrix successfully estimates the cross-fading curves by filtering out weights inconsistent with the temporal dependencies of each source.

The disclosed techniques were evaluated on five classes of sound sources—speech, music, applause, gun shot, and car. Ten clips of sound files were collected for each sound class. Speech and music files were extracted from movies, each about 25 seconds long. Other sound files were obtained from a sound effects library, with lengths varying from less than one to five seconds. All of the sounds were resampled to 8 kHz and used a 64 ms Hann window with 32 ms overlap to compute the spectrograms. In the training phase, a dictionary of elements and a transition matrix were obtained separately for each sound source. The size of the dictionary was set to small numbers (e.g., less than 15) because a high-quality reconstruction was not necessary. In addition, dictionary sizes of speech and music were set to be greater than those of other environment sounds because speech and music may have more variations in the training data. The results of the evaluation are shown in FIG. 10 and Tables 1-3.

Figure 10:
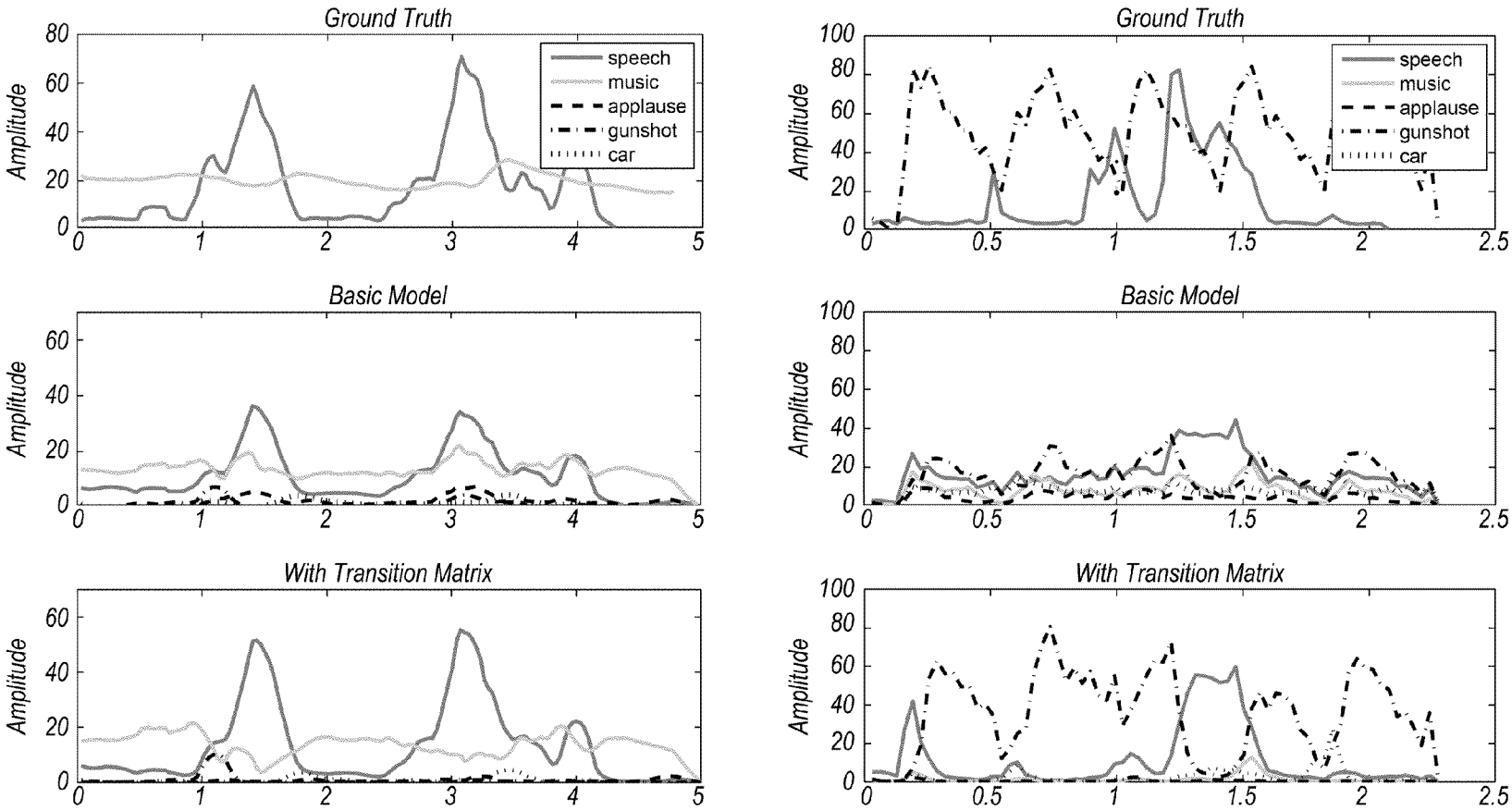
FIG. 10 illustrates a comparison of various embodiments of mixture weight estimation for sound mixtures.

FIG. 10 illustrates an example comparison of various embodiments of mixture weight estimation for sound mixtures having two sources. For the mixture of speech and music sounds, both models recognize the two sources fairly well. However, in the basic model, separation between speech and music is somewhat diluted and loud utterances of speech are partly explained by other sources, which are absent from the test sound. The model with the transition matrix shows better separation between speech and music and suppresses other sources more effectively. For the mixture of speech and gunshot sounds, the two models show more apparent differences. The basic model shows the gunshot sound to be represented by many other sources, whereas the model using the transition matrix restores the original envelopes fairly well.

In order to examine the two models more accurately, a formal evaluation using ten-fold cross-validation was performed. At each validation stage, the dataset was split into nine training files and one test file for each source. From the training files, the models were trained with ten sets of dictionary sizes; the maximum numbers of dictionary sizes were 12, 15, 5, 5, and 8 for speech, music, applause, gunshot, and car sounds, respectively. The minimum numbers were 1 for each of the sources. For the model with the transition matrix, four reweighting strengths (C=0.3, 0.5, 0.7, and 1.0) were used. For the test files, the relative proportions for single sources and mixtures of two and three sources were estimated. The mixtures were created by mixing two or three test files with different relative gains. For mixtures of two sources, the relative gains of the two sources were adjusted to be −12, −6, 0, 6, and 12 in dB. For mixtures of three sources, they were adjusted to be −6, 0, and 6 in dB for each pair. To quantify the estimation accuracy, the following metric was computed:

$$\text{Estimation error} = \frac{1}{N}\sum_{s}\sum_{t}|r_t(s) - g_t(s)|,$$

where $r_t(s)$ is the estimated proportion from above, $g_t(s)$ is the ground truth proportion, and N is the number of time frames in the test file. The ground truth proportion was obtained from the ratio of envelope between each single source and the mixture at each time frame. The envelope was computed by summing the magnitudes in that time frame ($\Sigma_f X(f,t)$). The metric was measured only for active sources (e.g., those sources that exist in the test sound). Note that the ground truth proportion is 1 for single test sounds because no other sound is present in that case.

Table 1 shows the results for the single test source case. In the basic model, the significant proportion of the test sound is explained by dictionaries of other sources, particularly for gun shot sounds. However, the model with the transition matrix shows significant improvement for most sounds. Tables 2 and 3 show the results for the mixtures of two and three sources. Although the improvements are slightly less than those in the single source case, the model with the transition matrix generally outperforms the basic model. Note that as more sources are included in the test sound, the estimation errors for individual sources become smaller because the relative proportions of single sources are also smaller.

TABLE 1

Single Source Estimation Error

| Test sources | Speech | Music | Applause | Gun | Average |
|---|---|---|---|---|---|
| Without Transition Matrix | 0.37 | 0.45 | 0.20 | 0.76 | 0.41 |
| With Transition Matrix | 0.26 | 0.32 | 0.03 | 0.42 | 0.39 |

TABLE 2

Mixture of Two Sources Estimation Error

| | Speech/Music | Speech/Gun | Speech/Applause | Music/Car |
|---|---|---|---|---|
| Without Transition Matrix | 0.17/0.27 | 0.19/0.48 | 0.13/0.16 | 0.26/0.25 |
| With Transition Matrix | 0.15/0.21 | 0.15/0.34 | 0.13/0.12 | 0.21/0.26 |

TABLE 3

Mixture of Three Sources Estimation Error

| | Speech/Music/Gun | Speech/Music/Car |
|---|---|---|
| Without Transition Matrix | 0.17/0.21/0.25 | 0.16/0.20/0.20 |
| With Transition Matrix | 0.15/0.18/0.25 | 0.15/0.17/0.21 |

Figure 11:
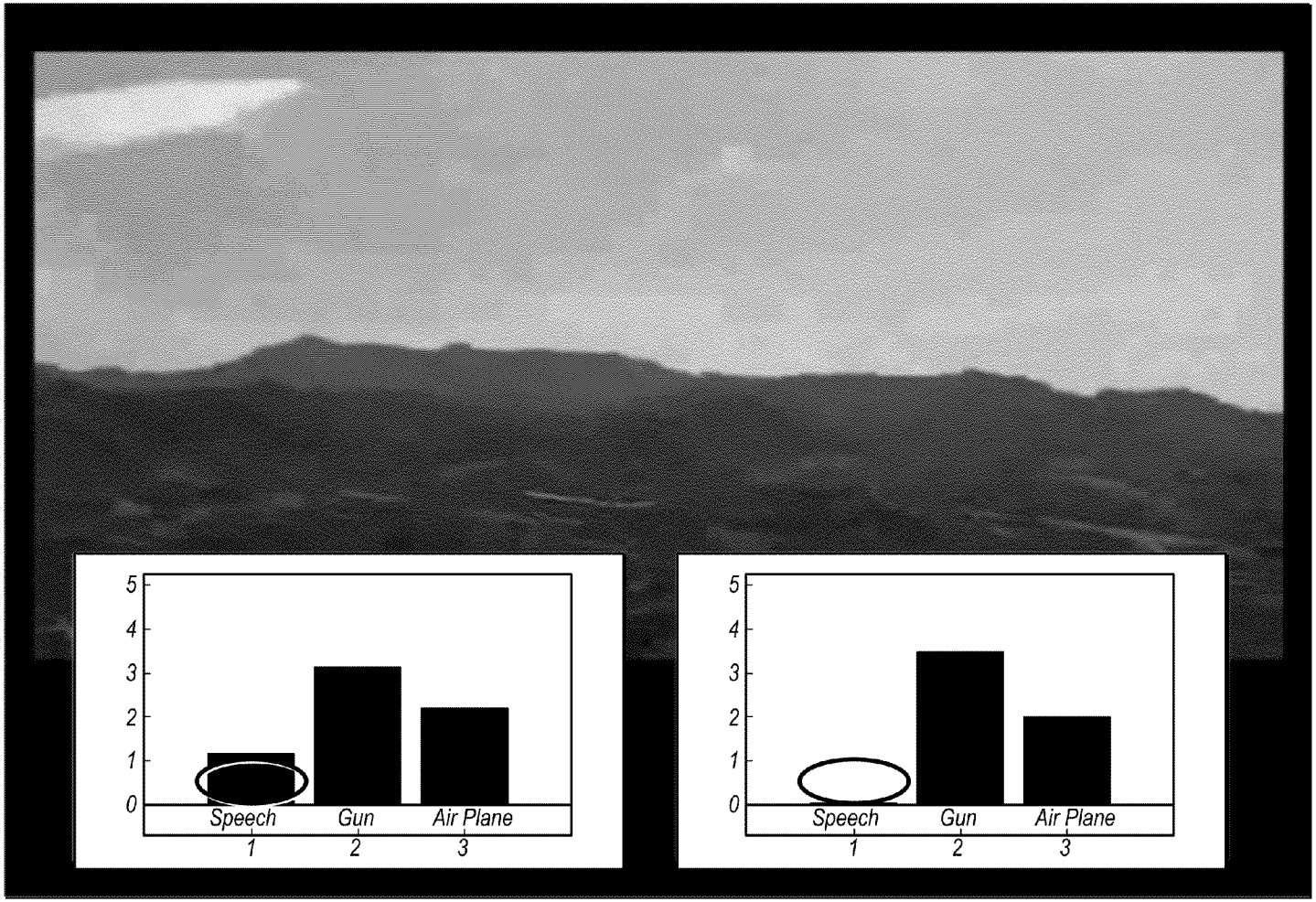
FIG. 11 illustrates example graphical illustrations of weight estimations, according to some embodiments.

FIG. 11 illustrates example graphical illustrations of weight estimations according to some embodiments. The graphical illustrations are shown as overlays over a frame from a movie scene that is being analyzed for source distribution according to the disclosed techniques. In this example, the frame of the movie scene shown does not include speech but instead includes gun and airplane sound sources. Two overlays are shown in FIG. 11 for comparison purposes. In some embodiments where an overlay is used, only one overlay may be displayed. In the overlay on the left, the mixture weights have been estimated without using a transition matrix to refine the estimations whereas in the example on the right, a transition matrix was used to refine the estimations. As shown in this example, using a transition matrix to refine weight mixture estimations may produce improved accuracy than by using techniques without a transition matrix. Specifically, in the illustrated frame, the overlay on the left erroneously indicates some amount of speech whereas the overlay on the right more accurately depicts the actual mixture weight proportions.

***

CONCLUSION

Various embodiments may further include receiving, sending or storing instructions and/or data implemented in accordance with the foregoing description upon a computer-accessible medium. Generally speaking, a computer-accessible medium may include storage media or memory media such as magnetic or optical media, e.g., disk or DVD/CD-ROM, volatile or non-volatile media such as RAM (e.g. SDRAM, DDR, RDRAM, SRAM, etc.), ROM, etc., as well as transmission media or signals such as electrical, electromagnetic, or digital signals, conveyed via a communication medium such as network and/or a wireless link.

The various methods as illustrated in the Figures and described herein represent example embodiments of methods. The methods may be implemented in software, hardware, or a combination thereof. The order of method may be changed, and various elements may be added, reordered, combined, omitted, modified, etc.

Various modifications and changes may be made as would be obvious to a person skilled in the art having the benefit of this disclosure. It is intended that the embodiments embrace all such modifications and changes and, accordingly, the above description to be regarded in an illustrative rather than a restrictive sense.

What is claimed is:

1. A method comprising:

receiving, by a computing device, a sound mixture that includes a plurality of sources;

receiving, by the computing device, a model that includes a dictionary of spectral basis vectors and a transition matrix that includes temporal information, representing a temporal dependency among the spectral basis vectors, for each of the plurality of sources, the model being computed using a source separation algorithm;

estimating, by the computing device and based on the model, a weight of each of the plurality of sources in the sound mixture; and using the weights of the plurality of sources in the sound mixture by an application of the computing device to search the sound mixture for at least one of the plurality of sources of sound.

2. The method of claim 1, further comprising refining the estimated weight of each of the plurality of sources based on the transition matrix.

3. The method of claim 1, wherein said estimating and said refining are performed iteratively.

4. The method of claim 1, wherein the dictionary of spectral basis vectors is a composite dictionary that includes a respective dictionary for each of the plurality of sources.

5. The method of claim 4, wherein each respective dictionary is computed based on training data for the respective one of the plurality of sources.

6. The method of claim 1, wherein the dictionary is computed using a probabilistic latent component analysis (PLCA) algorithm.

7. The method of claim 1, wherein said estimating the weight is performed for each time frame of the sound mixture.

8. The method of claim 1, further comprising receiving input specifying multiple types of sources of the plurality of sources prior to said estimating the weight, wherein said estimating the weight is for each of the specified multiple types of sources.

9. The method of claim 1, wherein the model is a composite model of respective models for each sound class, wherein each respective model is based on isolated training data for the corresponding sound class.

10. The method of claim 1, wherein said estimating the weight of each of the plurality of sources in the sound mixture is performed using a source separation algorithm.

11. The method of claim 10, wherein said estimating the weight of each of the plurality of sources in the sound mixture is performed without separating the plurality of sources.

12. A non-transitory computer-readable storage medium storing program instructions, the program instructions being computer-executable to implement operations comprising:

receiving, by a computing device, a sound mixture that includes a plurality of sources;

receiving, by the computing device, a composite model for the plurality of sources, wherein the composite model includes, for each of the plurality of sources, a respective model that includes a dictionary of spectral basis vectors and a transition matrix that represents a temporal dependency among the corresponding spectral basis vectors for the respective source, the composite model being computed using a source separation algorithm;

estimating, by the computing device, a weight for each of the plurality of sources in the sound mixture based on the composite model; and using the weights of the plurality of sources in the sound mixture by an application of the computing device to search the sound mixture for at least one of the plurality of sources of sound.

13. The non-transitory computer-readable storage medium of claim 12, wherein the operations further comprise refining the estimated weight of each of the plurality of sources based on a transition matrix.

14. The non-transitory computer-readable storage medium of claim 12, wherein said estimating is performed for each time frame of the sound mixture.

15. The non-transitory computer-readable storage medium of claim 12, wherein said estimating the weight of each of the plurality of sources in the sound mixture is performed using a source separation algorithm without separating the plurality of sources.

16. The non-transitory computer-readable storage medium of claim 12, wherein the dictionary of spectral basis vectors includes a respective dictionary for each of the plurality of sources.

17. A computing device comprising:

at least one processor device; and a memory comprising program instructions, wherein the program instructions are executable by the at least one processor to:

receive a sound mixture that includes a plurality of sources;

receive a composite model for the plurality of sources, wherein the composite model includes, for each of the plurality of sources, a respective model that includes a dictionary of spectral basis vectors and a transition matrix that indicates one or more probabilities for transition between dictionaries of a respective source, the composite model being computed using a source separation algorithm;

estimate a weight for each of the plurality of sources in the sound mixture based on the composite model; and using the weights of the plurality of sources in the sound mixture by an application of the computing device to search the sound mixture for at least one of the plurality of sources of sound.

18. The computing device of claim 17, wherein the transition matrix of each respective model represents a temporal dependency among the corresponding spectral basis vectors for the respective source, and wherein the program instructions are further executable by the at least one processor to refine the estimated weight of each of the plurality of sources based on the transition matrix.

19. The computing device of claim 17, wherein the estimating the weight is performed for each time frame of the sound mixture.

20. The computing device of claim 17, wherein the dictionary of spectral basis vectors includes a respective dictionary for each of the plurality of sources.

* * * * *